US008176605B2

(12) United States Patent
Mok

(10) Patent No.: US 8,176,605 B2
(45) Date of Patent: May 15, 2012

(54) AUTO-LOCK SAFETY BUCKLE

(76) Inventor: Yuet Ying Maggie Mok, Hong Kong (HK)

( * ) Notice: Subject to any disclaimer, the term of this patent is extended or adjusted under 35 U.S.C. 154(b) by 841 days.

(21) Appl. No.: 11/967,280

(22) Filed: Dec. 31, 2007

(65) Prior Publication Data

US 2009/0100652 A1 Apr. 23, 2009

(30) Foreign Application Priority Data

Oct. 23, 2007 (CN) ..... 2007 1 0165619

(51) Int. Cl.
*A44B 11/25* (2006.01)

(52) U.S. Cl. ..... 24/614; 24/613; 24/615; 24/625

(58) Field of Classification Search ..... 24/625, 24/613–615, 617, 627, 640
See application file for complete search history.

(56) References Cited

U.S. PATENT DOCUMENTS

| | | | | | |
|---|---|---|---|---|---|
| 1,737,246 | A | * | 11/1929 | Jones | 24/616 |
| 2,446,951 | A | * | 8/1948 | Quilter | 24/609 |
| 4,404,715 | A | | 9/1983 | Sugimoto | |
| 5,311,649 | A | * | 5/1994 | Suh | 24/625 |
| 5,359,756 | A | * | 11/1994 | Miyauchi et al. | 24/603 |
| 5,845,376 | A | * | 12/1998 | Tung | 24/625 |
| 5,991,985 | A | * | 11/1999 | Galbreath | 24/625 |
| 6,061,883 | A | | 5/2000 | Uehara | |
| 6,138,330 | A | * | 10/2000 | Galbreath | 24/625 |
| 6,145,172 | A | * | 11/2000 | Bourdon | 24/625 |
| 6,163,942 | A | * | 12/2000 | Liao | 24/625 |
| 6,237,826 | B1 | * | 5/2001 | Gould | 224/660 |
| 6,560,830 | B1 | * | 5/2003 | Chi | 24/653 |
| 6,796,007 | B1 | * | 9/2004 | Anscher | 24/633 |
| 6,871,517 | B2 | * | 3/2005 | Bonelli et al. | 70/58 |
| 7,150,082 | B2 | * | 12/2006 | Beletsky | 24/625 |
| 7,219,406 | B2 | * | 5/2007 | Chui | 24/625 |

FOREIGN PATENT DOCUMENTS

| | | | |
|---|---|---|---|
| CN | 2286558 | Y | 7/1998 |
| CN | 2339026 | Y | 9/1999 |
| CN | 2432810 | Y | 6/2001 |
| CN | 2534864 | Y | 2/2003 |
| EP | 1723866 | A1 | 11/2006 |

* cited by examiner

*Primary Examiner* — Robert J Sandy
*Assistant Examiner* — Tyler Johnson

(57) ABSTRACT

A buckle, operating between a locked position and a released position, comprising a male buckle member having a plurality of locking members, and a female buckle member. The female buckle member includes a housing, a plurality of engaging portions formed on the housing for engaging with the locking members, a latch member slidably disposed in the housing for preventing the locking members from disengaging with the engaging portions in the locked position, and a bias device connecting the latch member to the housing for biasing said latch member against the locking member in the locked position.

13 Claims, 5 Drawing Sheets

AUTO-LOCK SAFETY BUCKLE

CROSS-REFERENCE TO RELATED APPLICATION

This application claims priority from Chinese Patent Application No. 200710165619.8 filed on Oct. 23, 2007.

FIELD OF THE INVENTION

The present invention relates to a buckle, in particular, a female buckle member with a safety latch to prevent the buckle from being unlocked accidentally or without the awareness of the user.

BACKGROUND OF THE INVENTION

Snap buckles are commonly used as fastening means in waist bags which are frequently used by travelers, or in other bags and accessories. The snap buckle can usually be opened easily, or sometimes even accidentally without knowing by the user. It is not surprising that the snap buckle of a traveler's waist bag is unlocked by thieves without the knowledge of the user, especially in a crowded area.

It is disclosed in U.S. Pat. No. 7,219,406 a buckle with a safety latch to prevent the locking members from being disengaged in the locked position. Once buckled, the user has to manually set the safety latch to the secured position by moving a raised button. One disadvantage of the cited patent is that it requires an extra step from the user in locking the buckle, which is not convenient to the user. The user tends to forget to move the safety button when locking the buckle. Another disadvantage is that the user has to push down the raised button before releasing the raised button from the locked position to the disengaged position, which causes inconvenience to the user when unlocking the buckle.

The latch in the cited patent is disposed on the elongated bar of the male buckle member, which is a relatively fragile part due to its elongated shape and the slot therein for the latch to slide along. The latch being disposed on the elongated bar will make the elongated bar easy to break upon repeated use. The latch is exposed on the male buckle member, which makes it easy to be damaged and affects the look of the male buckle member.

In addition, in order to match with the male buckle member, the female buckle member has to further include a slot opening to receive the raised button on the latch. Therefore, the male buckle member is not compatible with any common female buckle member. A female buckle member compatible with the male buckle member of the cited patent has to be manufactured, which increases the manufacturing costs of the buckle.

SUMMARY OF THE INVENTION

It is an objective of the present invention to provide an improved buckle which is more convenient to the user.

The buckle of the present invention operates between a locked position and a released position, and comprises a male buckle member having a plurality of locking members, and a female buckle member. The female buckle member includes a housing, a plurality of engaging portions formed on the housing for engaging with the locking members, and a latch member slidably disposed in the housing for preventing the locking members from disengaging with the engaging portions in the locked position. The latch member is contained and protected in the housing of the female buckle member.

A bias device is disposed in the female buckle member to connect the latch member to the housing for biasing the latch member against the locking member in the locked position. In the locked position when the male buckle member is engaged with the female buckle member, the latch member is automatically pushed against the locking members by the bias device, and prevents accidental or unwanted release of the locking members.

In the released position, the latch member is moved against the bias device by the user to disengage the locking members with the engaging portions.

The main improvement of the present invention is related to the female buckle member. The female buckle member will be compatible with a common male buckle member.

BRIEF DESCRIPTION OF THE DRAWINGS

The above and other aspects, features, and advantages of the present invention will become more apparent upon consideration of the following detailed description of preferred embodiments, taken in conjunction with the accompanying figures, wherein:—

DESCRIPTION OF A PREFERRED EMBODIMENT OF THE INVENTION

Figure 1:
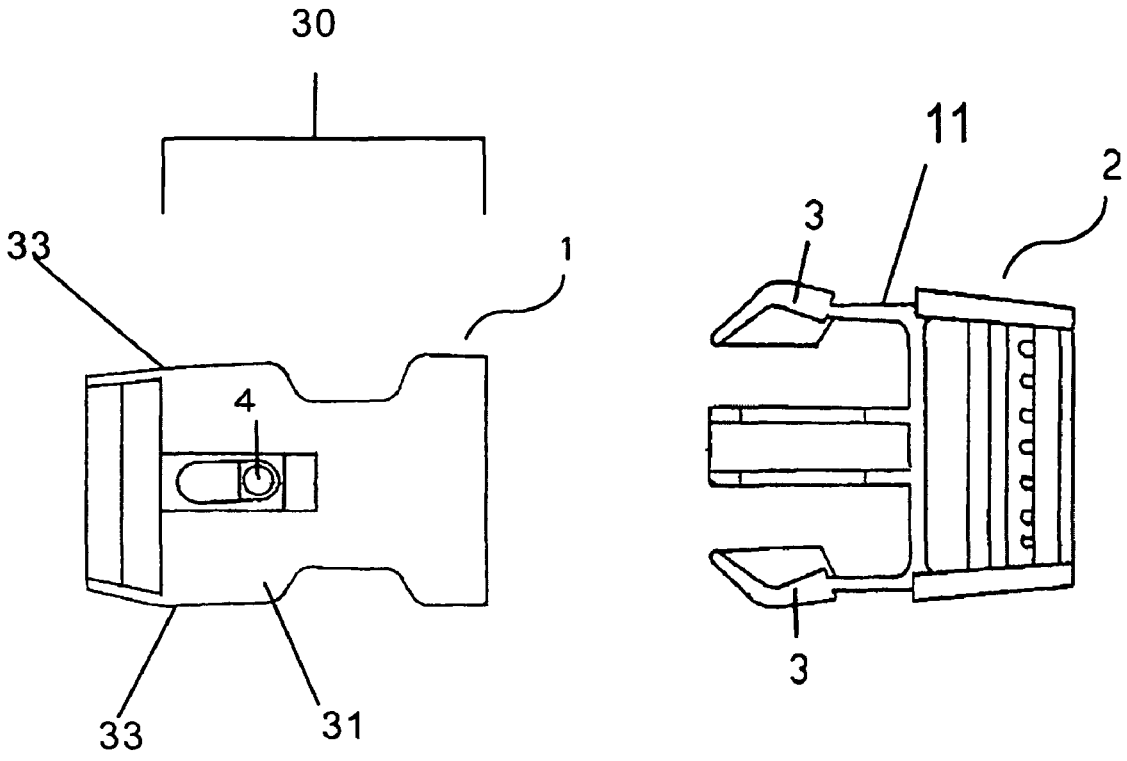
FIG. 1 is a top view of the female and male buckle member according to an embodiment of this invention.
Figure 2:
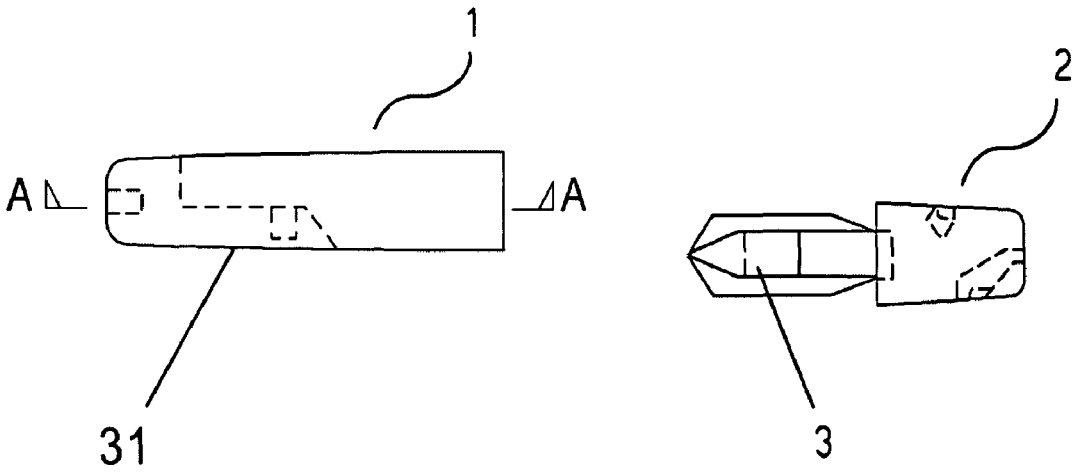
FIG. 2 are the perspective side views of the female and male buckle member of FIG. 1.

As shown in FIGS. 1 and 2, the buckle includes a female buckle member 1 and a male buckle member 2. The female buckle member 1 includes a housing 30 with a first wall 31 and two side walls 33. When the buckle is used on a waist bag, the first wall 31 faces the human body. The male buckle member 2 may be a common male buckle member known in the art with a locking member 3 disposed on each side of the male buckle member 2 for locking with the female buckle member 1. The engaging portion 3 is disposed at the end of a flexible arm 11 so that the engaging portions 3 can be pushed inward when inserting into the female buckle member 1.

Figure 3:
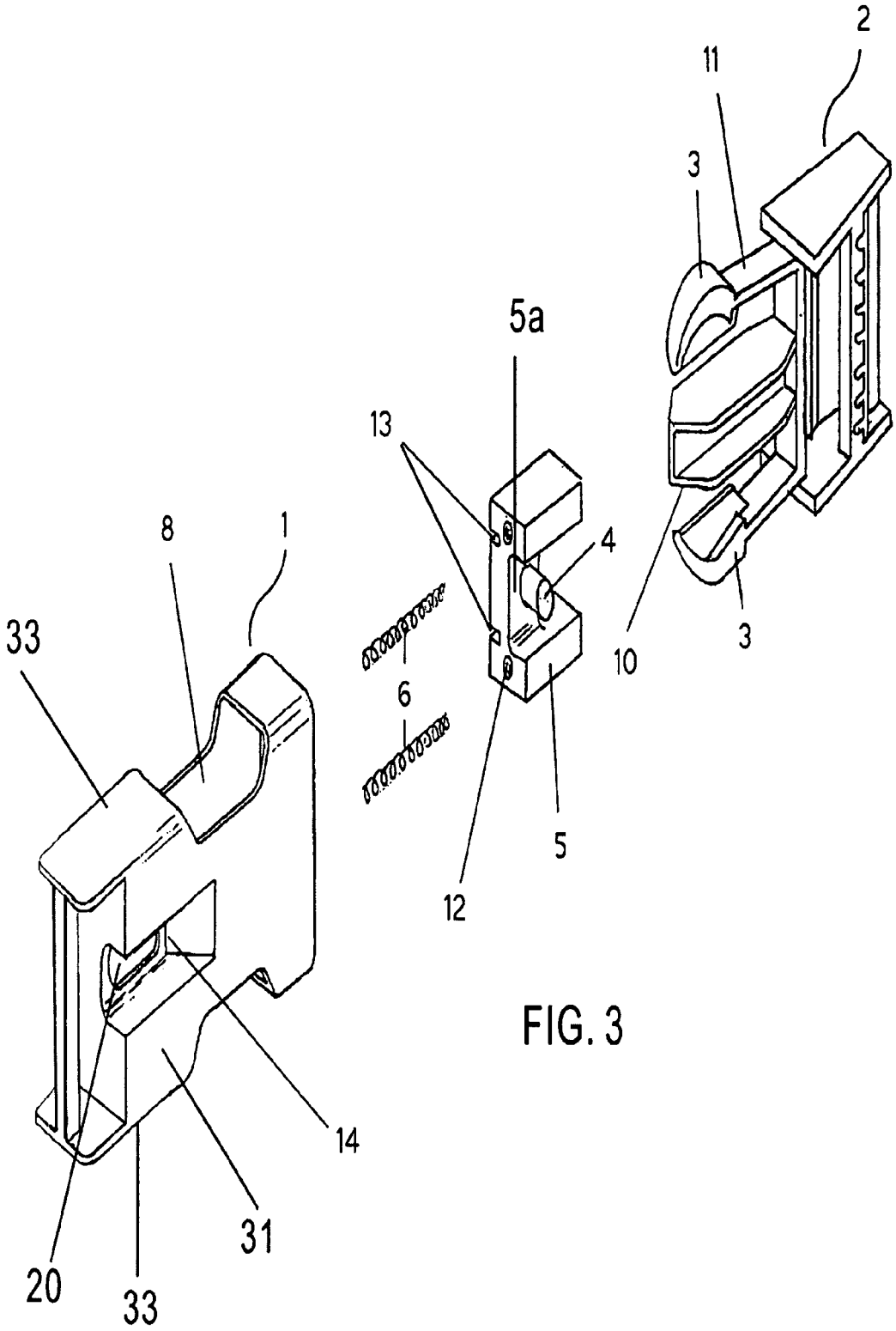
FIG. 3 is the explosive perspective view of the female and male buckle member of FIG. 1.
Figure 4:
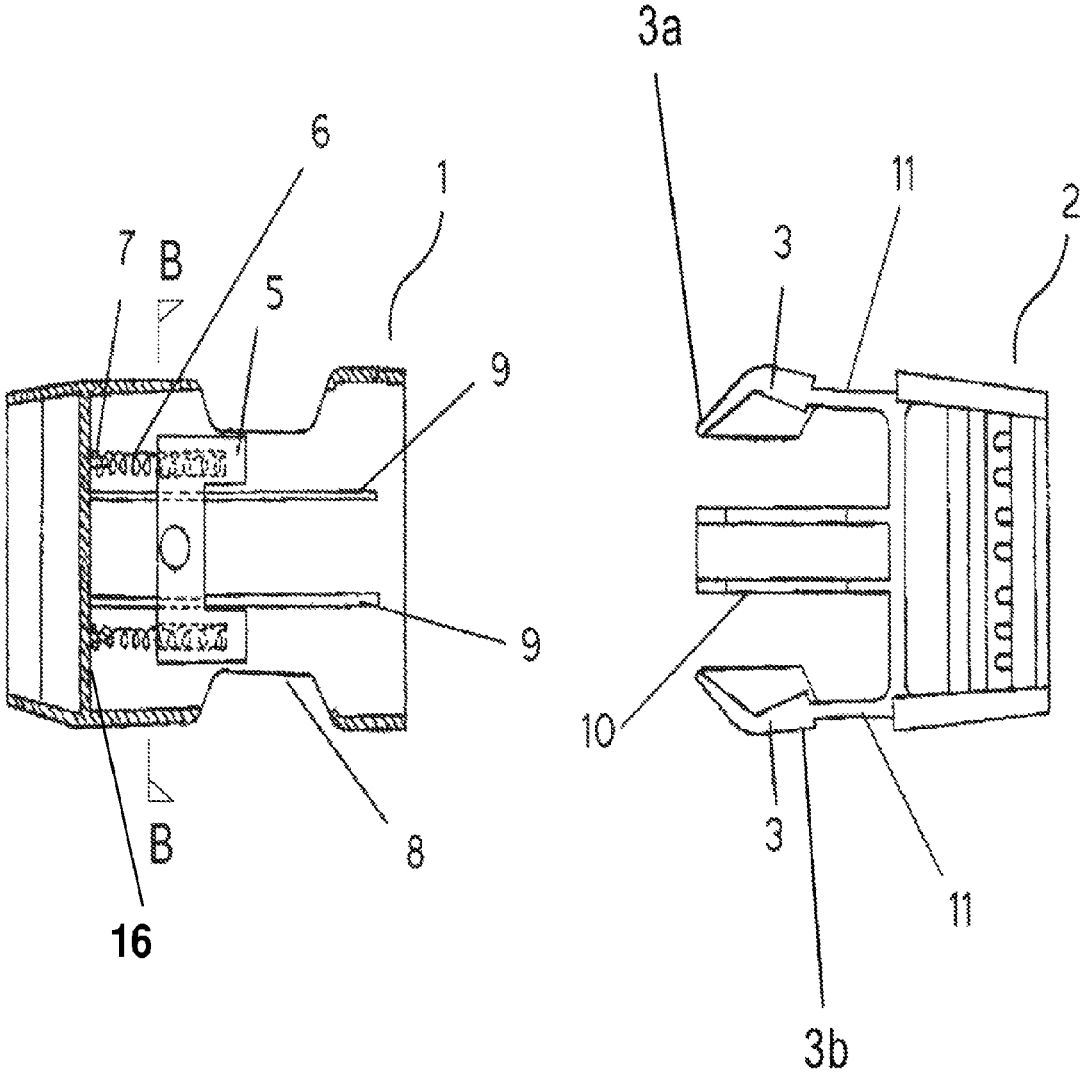
FIG. 4 are the sectional views of the female and male buckle member along line A-A of FIG. 2.

As shown in FIGS. 3 and 4, the female buckle member 1 includes an engaging portion 8 on each side wall 33 for engaging with the locking member 3 of the male buckle member 2. The engaging portion 8 may be an opening configured to match with the shape and size of the locking member 3.

A latch member 5 is slidably disposed in the housing 30 for preventing the locking members 3 from disengaging with the engaging portions 8 in the locked position. The latch member 5, for example, is of a rectangular shape. The latch member 5 has an indented portion 5*a* for disposing a handle 4 for the user to slide the latch member 5 inside the housing 30. A pit 14 is formed on the first wall 31 to contain the handle 4 so that the handle will not stick out above the first wall 31 and cause discomfort to the user when the first wall 31 is facing the human body in use. A slot 20 is formed on the pit 14 for the handle 4 to extend through the slot 20 and for the handle 4 to slide along in the slot 20.

A bias device 6 connects the latch member 5 with the housing 30 for biasing the latch member 5 against the locking members 3 in the locked position. The bias device 6 may be for example, one or more springs, or other devices with a biasing characteristic. In the present invention, the bias device 6 is a pair of springs with one end attached to two corresponding holes 12 disposed on the latch member 5, and the other end supported by two corresponding posts 7 extending from the inner surface 16 of the housing 30.

Figure 6:
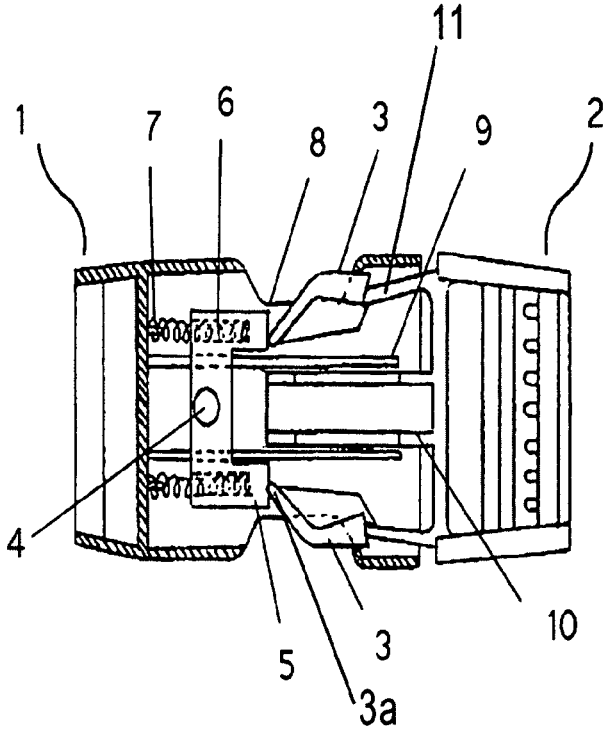
FIG. 6 is the sectional view illustrating the insertion of the male buckle member into the female buckle member of FIG. 1.
Figure 5:
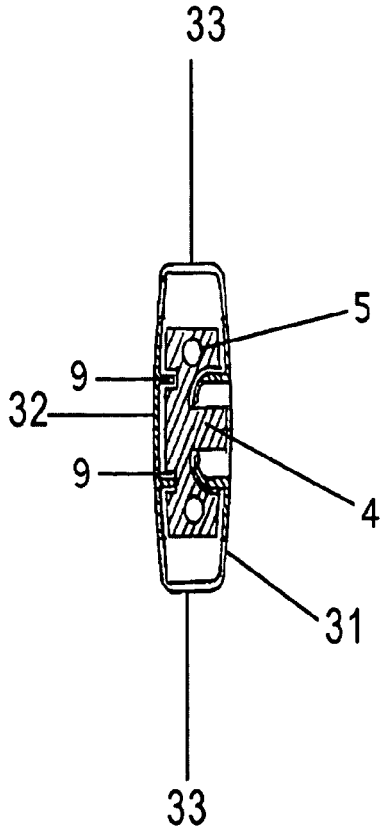
FIG. 5 is the sectional view of the female buckle member along line B-B of FIG. 4.

As shown in FIGS. 3, 5 and 6, a guiding device is disposed on the housing 30 and the latch member 5 to facilitate the sliding movement of the latch member 5 inside the housing 30. The guiding device, for example, may be two guide rails 9 formed on the second wall 32 inside the housing 30 and two corresponding guide rail grooves 13 formed on the latch member 5.

Figure 7:
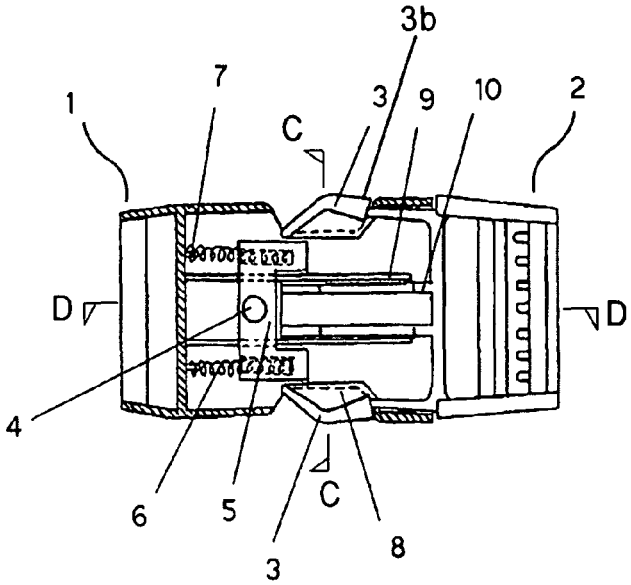
FIG. 7 is the sectional view illustrating the locked position of the female and male buckle member of FIG. 1.
Figure 8:
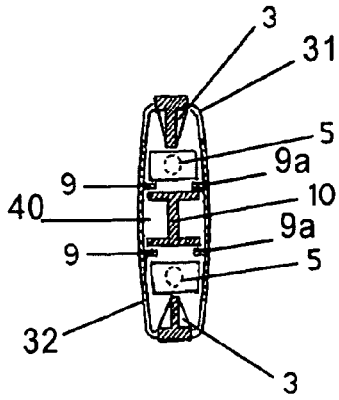
FIG. 8 is the sectional view of the male and female buckle member along line C-C of FIG. 7.
Figure 9:
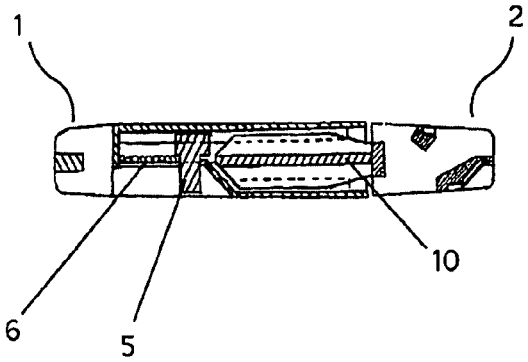
FIG. 9 is the sectional view of the male and female buckle member along line D-D of FIG. 7.

As shown in FIGS. 7 and 8, the male buckle member 2 includes an elongated portion 10 extending between the locking members 3. Two guide rails 9*a* are formed on the first wall 31 inside the housing 30 opposite to the two guide rails 9 on the second wall 32 to form a channel 40 for receiving and guiding the insertion of the elongated portion 10 into the female buckle member 1. The guide rails 9*a* are of similar length as that of the elongated portion 10.

As shown in FIG. 4, each locking member 3 includes a forward end 3*a* narrowing inward towards each other. Such configuration makes it easier for the locking member 3 to enter into the housing 30 of the female buckle member 1. The locking member 3 further includes an extended portion 3*b* extending outward for locking with the engaging portion 8, so that the locking members 3 have to be squeezed inward for the extended portion 3*b* to disengage with the engaging portions 8 when the buckle is released.

As shown in FIGS. 6 and 7, when the male buckle member 2 enters into the female buckle member 1, the flexible arms 11 are bended inward for the locking members 3 to enter into the housing 30. The forward ends 3*a* push the latch member 5 and compress the bias device 6 from the initial position, until the flexible arms 11 return to the un-bended position and the extended portions 3*b* lock with the engaging portions 8. The bias device 6 then returns the latch member 5 back to the initial position and prevents the locking members 3 from being squeezed inward to disengage with the engaging portions 8.

To release the buckle, the user has to move the handle 4 to slide the latch member 5 away from and release the locking members 3. The locking members 3 can then be squeezed inward to disengage with the engaging portions 8.

The embodiments described in this specification and the contents disclosed therein are provided by way of illustration only. The invention can be applied equally well on other types of buckle.

While the invention has been described in detail with reference to disclosed embodiments, various modifications within the scope of the invention will be apparent to those of ordinary skill in this technological field. It is to be appreciated that features described with respect to one embodiment typically may be applied to other embodiments.

What is claimed is:

1. A female buckle member for operating with a corresponding male buckle member with a plurality of locking members between a locked position and a released position, comprising:

a housing comprising an opening for receiving said locking members and a surface facing said opening, wherein said surface faces the male buckle member in the locked position, a plurality of engaging portions formed on said housing for engaging with said corresponding locking members, a latch member slidably disposed in said housing for preventing said locking members from disengaging with said engaging portions in the locked position comprising a handle, wherein said latch member is slidably moved away by the handle from said locking members for said locking members to disengage with said engaging portions from the locked position to the released position, and a bias device disposed between said surface and the latch member, wherein the latch member is disposed between the bias device and said opening, wherein, the latch member is pushed by the locking members to press against the bias device into the locked position, the bias device is then released to engage the latch member with the locking members in the locked position.

2. The female buckle member, as recited in claim 1, wherein said latch member is moved against said bias device for said locking members to disengage with said engaging portions in the released position.

3. The female buckle member, as recited in claim 1, wherein said housing further comprising a first wall with a pit and a slot formed therein for said handle to slide along said pit and slot.

4. The female buckle member, as recited in claim 1, wherein said female buckle member further comprises a guiding device for guiding said latch member to slide inside said housing.

5. The female buckle member, as recited in claim 4, wherein said guiding device comprises at least one guide rail groove formed on said latch member and at least one corresponding guide rail formed inside said housing.

6. The female buckle member, as recited in claim 1, wherein said housing having two opposite side walls, each of said engaging portions comprises an opening formed on each said side wall.

7. The female buckle member, as recited in claim 1, wherein said bias device comprises at least one spring.

8. The female buckle member, as recited in claim 3, wherein said latch member further comprises an indented portion for disposing said handle.

9. A female buckle member for operating with a corresponding male buckle member with a plurality of locking members between a locked position and a released position, comprising:

a housing comprising an opening for receiving said locking members and a surface facing said opening, wherein said surface faces the male buckle member in the locked position, said housing having a first wall with a pit and a slot formed therein, a second wall opposite to said first wall, and two side walls, an opening formed on each said side wall for engaging with said corresponding locking member, a latch member slidably disposed in said housing for preventing said locking member from disengaging with said opening in the locked position, having a handle moveable along said pit and slot, and at least one guide rail groove formed on said latch member, at least one corresponding guide rail formed inside said housing on said second wall for said latch member to slide thereon, and a bias device disposed between said surface and the latch member, wherein the latch member is disposed between the bias device and said opening, wherein, the latch member is pushed by the locking members to press against the bias device into the locked position, the bias device is then released to engage the latch member with the locking members in the locked position, wherein said latch member is moved by the handle against said bias device for said locking members to disengage with said engaging portions from the locked position to the released position.

10. A buckle operating between a locked position and a released position, comprising:

a male buckle member comprising a plurality of locking members;

a female buckle member comprising a housing comprising an opening for receiving said locking members and a surface facing said opening, wherein said surface faces the male buckle member in the locked position, a plurality of engaging portions formed on said housing for engaging with said corresponding locking members, a latch member slidably disposed in said housing for preventing said locking members from disengaging with said engaging portions in the locked position comprising a handle, wherein said latch member is moved against said bias device by the handle for said locking members to disengage with said engaging portions from the locked position to the released position, and a bias device disposed between said surface and the latch member, wherein the latch member is disposed between the bias device and said opening, wherein, the latch member is pushed by the locking members to press against the bias device into the locked position, the bias device is then released to engage the latch member with the locking members in the locked position.

11. The buckle, as recited in claim 10, wherein said male buckle member further comprises an elongated portion between said locking members, said housing having opposite first and second walls and two guide rails formed inside said housing on each said first and second wall to form a channel for receiving said elongated portion, whereby, said male buckle member is guided by said channel to enter smoothly into said female buckle member.

12. The buckle, as recited in claim 10, wherein each said locking member further comprises a forward end narrowing inwards towards each other.

13. The buckle, as recited in claim 10, wherein each said locking member further comprises an outwardly extended portion for locking with said corresponding engaging portion.

* * * * *